US006934676B2

(12) United States Patent
Wang et al.

(10) Patent No.: US 6,934,676 B2
(45) Date of Patent: Aug. 23, 2005

(54) METHOD AND SYSTEM FOR INTER-CHANNEL SIGNAL REDUNDANCY REMOVAL IN PERCEPTUAL AUDIO CODING

(75) Inventors: Ye Wang, Tampere (FI); Miikka Vilermo, Tampere (FI)

(73) Assignee: Nokia Mobile Phones Ltd., Espoo (FI)

( * ) Notice: Subject to any disclaimer, the term of this patent is extended or adjusted under 35 U.S.C. 154(b) by 0 days.

(21) Appl. No.: 09/854,143

(22) Filed: May 11, 2001

(65) Prior Publication Data

US 2003/0014136 A1 Jan. 16, 2003

(51) Int. Cl.[7] ..... G10L 19/00
(52) U.S. Cl. ..... 704/200.1; 704/230
(58) Field of Search ..... 704/200.1, 203, 704/205, 207, 219, 222, 230, 229; 381/2

(56) References Cited

U.S. PATENT DOCUMENTS

| | | | | |
|---|---|---|---|---|
| 4,375,100 A | * | 2/1983 | Tsuji et al. | 714/755 |
| 4,491,869 A | | 1/1985 | Heitmann | 358/141 |
| 5,610,908 A | * | 3/1997 | Shelswell et al. | 370/210 |
| 5,638,451 A | * | 6/1997 | Sedlmeyer | 381/18 |
| 5,737,720 A | * | 4/1998 | Miyamori et al. | 704/200.1 |
| 6,029,129 A | * | 2/2000 | Kliger et al. | 704/224 |

OTHER PUBLICATIONS

Chen et al, "Video Compression Using Integer DCT", Image Processing, 2000, Proceedings 2000 International Conference, vol. 2, pp. 844–845.*

Cheng et al, "Integer discrete cosine transform and its fast algorithm," Electronic Letters, vol. 37, Jan. 4, 2001, pp. 64–65.*

"Transform Coding with Integer–to–Integer Transforms", V. K. Goyal, IEEE Tranasactions on Information Theory, vol. 46, No. 2, Mar. 2000, pp. 465–473.

"An Inter–Channel Redundancy Removal Approach for High–Quality Multichannel Audio Compression"; D. Yang, H. Ai, C. Kyriakakis, C. J. Kuo; Presented at 109$^{th}$ AES Convention, Sep. 22–25, 2000, Los Angeles, CA.

* cited by examiner

*Primary Examiner*—Vijay Chawan
*Assistant Examiner*—Angela Armstrong
(74) *Attorney, Agent, or Firm*—Ware, Fressola, Van Der Sluys and Adolphson LLP

(57) ABSTRACT

A method and system for coding audio signals in a multi-channel sound system, wherein a plurality of MDCT units are used to reduce the audio signals for providing a plurality of MDCT coefficients. The MDCT coefficients are quantized according to the masking threshold calculated from a psychoacoustic model and a plurality of INT (integer-to-integer) DCT modules are used to remove the cross-channel redundancy in the quantized MDCT coefficients. The output from the INT-DCT modules is Huffman coded and written to a bitstream for transmission or storage.

17 Claims, 8 Drawing Sheets

METHOD AND SYSTEM FOR INTER-CHANNEL SIGNAL REDUNDANCY REMOVAL IN PERCEPTUAL AUDIO CODING

CROSS REFERENCES TO RELATED APPLICATIONS

The instant application is related to a previously filed patent application, Ser. No. 09/612,207, assigned to the assignee of the instant application, and filed Jul. 7, 2000, which is incorporated herein by reference.

FIELD OF THE INVENTION

The present invention relates generally to audio coding and, in particular, to the coding technique used in a multiple-channel, surround sound system.

BACKGROUND OF THE INVENTION

As it is well known in the art, the International Organization for Standardization (IOS) founded the Moving Pictures Expert Group (MPEG) with the intention to develop and standardize compression algorithms for video and audio signals. Among several existing multichannel audio compression alogrithms, MPEG-2 Advanced Audio Coding (AAC) is currently the most powerful one in the MPEG family, which supports up to 48 audio channels and perceptually lossless audio at 64 kbits/s per channel. One of the driving forces to develop the AAC algorithm has been the quest for an efficient coding method for surround sound signals, such as 5-channel signals including left (L), right (R), center (C), left-surround (LS) and right-surround (RS) signals, as shown in FIG. 1. Additionally, an optional low-frequency enhancement (LFE) channel is also used.

Generally, an N-channel surround sound system, running with a bit rate of M bps/ch, does not necessarily have a total bit rate of M×N bps, but rather the overall bit rate drops significantly below M×N bps due to cross channel (inter-channel) redundancy. To exploit the inter-channel redundancy, two methods have been used in MPEG-2 AAC standards: Mid-Side (MS) Stereo Coding and Intensity Stereo Coding/Coupling. Coupling is adopted based on psychoacoustic evidence that at high frequencies (above approximately 2 kHz), the human auditory system localizes sound based primarily on the "envelopes" of critical-band-filtered versions of the signals reaching the ears, rather than the signals themselves. MS stereo coding encodes the sum and the difference of the signal in two symmetric channels instead of the original signals in left and the right channels.

Both the MS Stereo and Intensity Stereo coding methods operate on Channel-Pairs Elements (CPEs), as shown in FIG. 1. As shown in FIG. 1, the signals in channel pairs are denoted by ($\mathbf{100}_L$, $\mathbf{100}_R$) and ($\mathbf{100}_{LS}$, $\mathbf{100}_{RS}$). The rationale behind the application of stereo audio coding is based on the fact that the human auditory system, as well as a stereo recording system, uses two audio signal detectors. While a human being has two ears, a stereo recording system has two microphones. With these two audio signal detectors, the human auditory system or the stereo recording system receives and records an audio signal from the same source twice, once through each audio signal detector. The two sets of recorded data of the audio signal from the same source contain time and signal level differences caused mainly by the positions of the detectors in relation to the source.

It is believed that the human auditory system itself is able to detect and discard the inter-channel redundancy, thereby avoiding extra processing. At low frequencies, the human auditory system locates sound sources mainly based on the inter-aural time difference (ITD) of the arrived signals. At high frequencies, the difference in signal strength or intensity level at both ears, or inter-aural level difference (ILD), is the major cue. In order to remove the redundancy in the received signals in a stereo sound system, the psychoacoustic model analyzes the received signals with consecutive time blocks and determines for each block the spectral components of the received audio signal in the frequency domain in order to remove certain spectral components, thereby mimicking the masking properties of the human auditory system. Like any perceptual audio coder, the MPEG audio coder does not attempt to retain the input signal exactly after encoding and decoding, rather its goal is to reduce the amount of audio data yet maintaining the output signals similar to what the human auditory system might perceive. Thus, the MS Stereo coding technique applies a matrix to the signals of the (L, R) or (LS, RS) pair in order to compute the sum and difference of the two original signals, dealing mainly with the spectral image at the mid-frequency range. Intensity Stereo coding replaces the left and the right signals by a single representative signal plus directional information.

While conventional audio coding techniques can reduce a significant amount of channel redundancy in channel pairs (L/R or LS/RS) based on the dual channel correlation, they may not be efficient in coding audio signals when a large number of channels are used in a surround sound system.

It is advantageous and desirable to provide a more efficient encoding system and method in order to further reduce the redundancy in the stereo sound signals. In particular, the method can be advantageously applied to a surround sound system having a large number of sound channels (6 or more, for example). Such system and method can also be used in audio streaming over Internet Protocol (IP) for personal computer (PC) users, mobile IP and third-generation (3G) systems for mobile laptop users, digital radio, digital television, and digital archives of movie sound tracks and the like.

SUMMARY OF THE INVENTION

The primary object of the present invention is to improve the efficiency in encoding audio signals in a sound system in order to reduce the amount of audio data for transmission or storage.

Accordingly, the first aspect of the present invention is a method of coding audio signals in a sound system having a plurality of sound channels for providing M sets of audio signals from input signals, wherein M is a positive integer greater than 2, and wherein a plurality of intra-channel signal redundancy removal devices are used to reduce the audio signals for providing first signals indicative of the reduced audio signals. The method comprises the steps of:

converting the first signals to data streams of integers for providing second signals indicative of the data streams; and reducing inter-channel signal redundancy in the second signals for providing third signals indicative of the reduced second signals.

Preferably, when the coding efficiency in the second signals is representable by a first value and the coding efficiency in the third signals is representable by a second value, the method further comprises the step of comparing the first value with second value for determining whether the reducing step is carried out.

Preferably, the audio signals from which the intra-channel signal redundancy is removed are provided in a form of pulsed code modulation samples.

Preferably, the intra-channel signal redundancy removal is carried out by a modified discrete cosine transform operation. Preferably, the inter-channel signal redundancy reduction is carried out in an integer-to-integer discrete cosine transform operation.

Preferably, the inter-channel signal redundancy reduction is carried out in order to reduce redundancy in the audio signals in L channels, wherein L is a positive integer greater than 2 but smaller than M+1.

Preferably, the method further includes a signal masking process according to a psychoacoustic model simulating a human auditory system for providing a masking threshold in the converting step.

Preferably, the method further includes the step of converting the reduced second signals into a bitstream for transmitting or storage.

According to the second aspect of the present invention, a system for coding audio signals in a sound system having a plurality of sound channels for providing M sets of audio signals from input signals, wherein M is a positive integer greater than 2, and wherein a plurality of intra-channel signal redundancy removal devices are used to reduce the audio signals for providing first signals indicative of the reduced audio signals. The system comprises:

means, responsive to the first signals, for converting the first signals to data streams of integers for providing second signals indicative of data streams; and means, responsive to the second signals, for reducing inter-channel signal redundancy in the second signals for providing third signals indicative of the reduced second signals.

Preferably, when the coding efficiency in the second signals is representable by a first value and the coding efficiency in the third signals is representable by a second value, the system further comprises means for comparing the first value with the second value for determining whether the second signals or the third signals are used to form a bitstream for transmission or storage.

Preferably, the audio signals from which the intra-channel signal redundancy is removed are provided in a form of pulsed code modulation samples.

Preferably, the intra-channel signal redundancy removal is carried out by a modified discrete cosine transform operation.

Preferably, the inter-channel signal redundancy reduction is carried out in an integer-to-integer discrete cosine transform operation.

Preferably, the inter-channel signal redundancy reduction is carried out in order to reduce redundancy in the audio signals in L channels, wherein L is a positive integer greater than 2 but smaller than M+1.

Preferably, the system further includes means for providing a masking threshold according to a psychoacoustic model simulating a human auditory system, wherein the masking threshold is used for masking the first signals in the converting thereof into the data streams.

The present invention will become apparent upon reading the description taken in conjunction with FIGS. 3 to 5.

DETAILED DESCRIPTION

Figure 1:
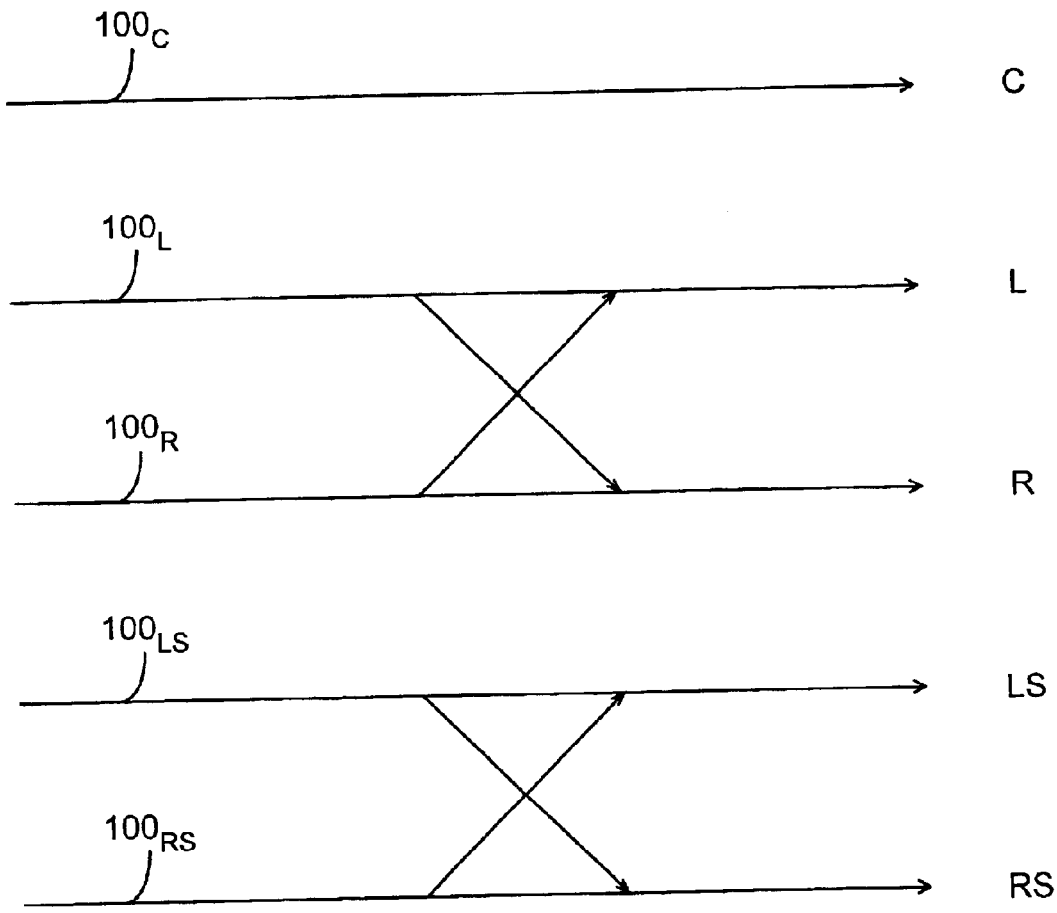
FIG. 1 (PRIOR ART)
FIG. 1 is a diagrammatic representation illustrating a conventional audio coding method for a surround sound system.
Figure 2:
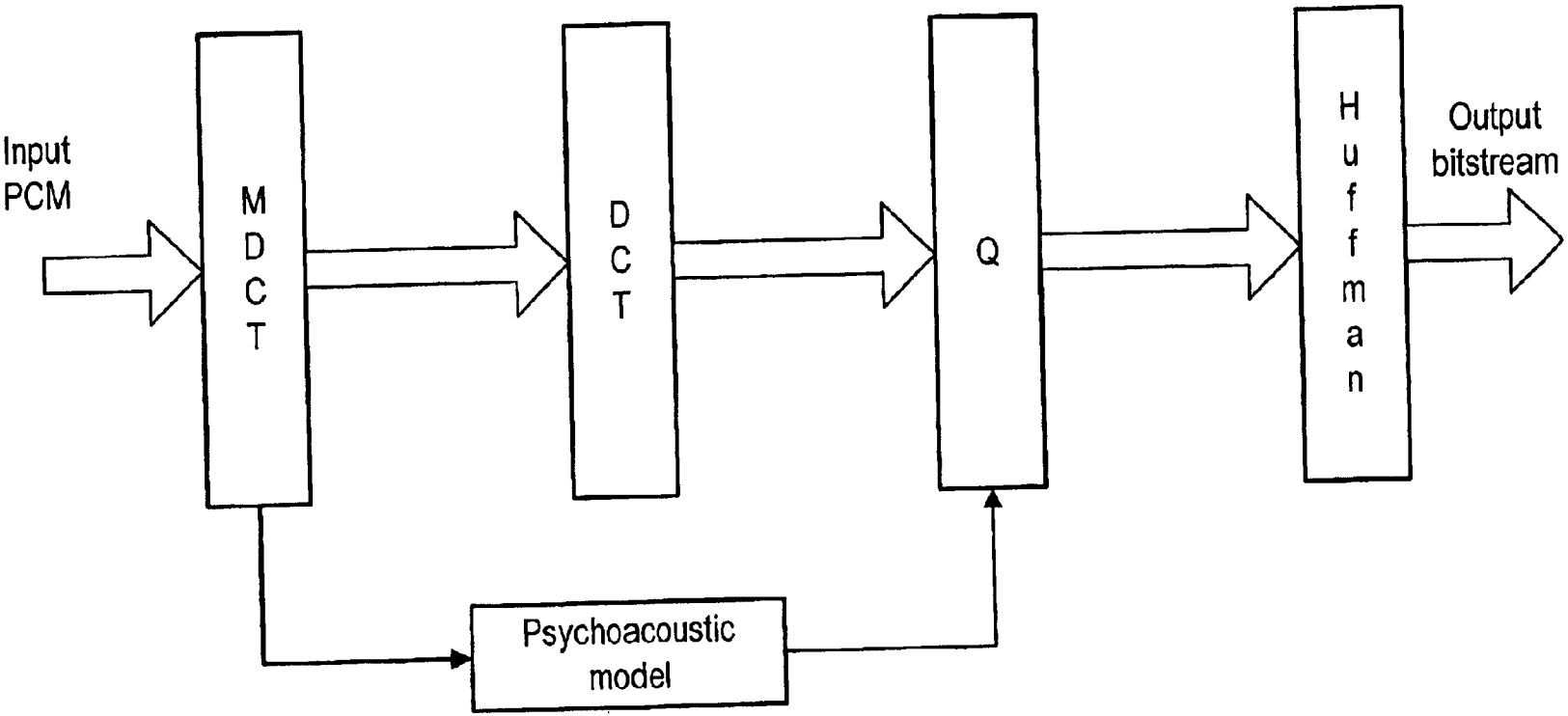
FIG. 2 is a diagrammatic representation illustrating an audio coding method for inter-channel signal redundancy reduction, wherein a discrete cosine transform operation is carried out prior to signal quantization.

The present invention improves the coding efficiency in audio coding for a sound system having M sound channels for sound reproduction, wherein M is greater than 2. In the method of the present invention, the individual or intra-channel masking thresholds for each of the sound channels are calculated in a fashion similar to a basic Advanced Audio Coding (AAC) encoder. This method is herein referred to as the intra-channel signal redundancy method. Basically, input signals are first converted into pulsed code modulation (PCM) samples and these samples are processed by a plurality of modified discrete cosine transform (MDCT) devices. According to a previously filed patent application Ser. No. 09/612,207, the MDCT coefficients from the multiple channels are further processed by a plurality of discrete cosine transform (DCT) devices in a cascaded manner to reduce inter-channel signal redundancy. The reduced signals are quantized according to the masking threshold calculated using a psychoacoustic model and converted into a bitstream for transmission or storage, as shown in FIG. 2. While this method can reduce the inter-channel signal redundancy, mathematically it is a challenge to relate the threshold requirements for each of the original channels in the MDCT domain to the inter-channel transformed domain (MDCT×DCT).

The present invention takes a different approach. Instead of carrying out the discrete cosine transform to reduce inter-channel signal redundancy directly from the modified discrete cosine transform coefficients, the modified discrete cosine transform coefficients are quantized according to the masking threshold calculated using the psychoacoustic model prior to the removal of cross-channel redundancy. As such, the discrete cosine transform for cross-channel redundancy removal can be represented by an M×M orthogonal matrix, which can be factorized into a series of Givens rotations.

Figure 3:
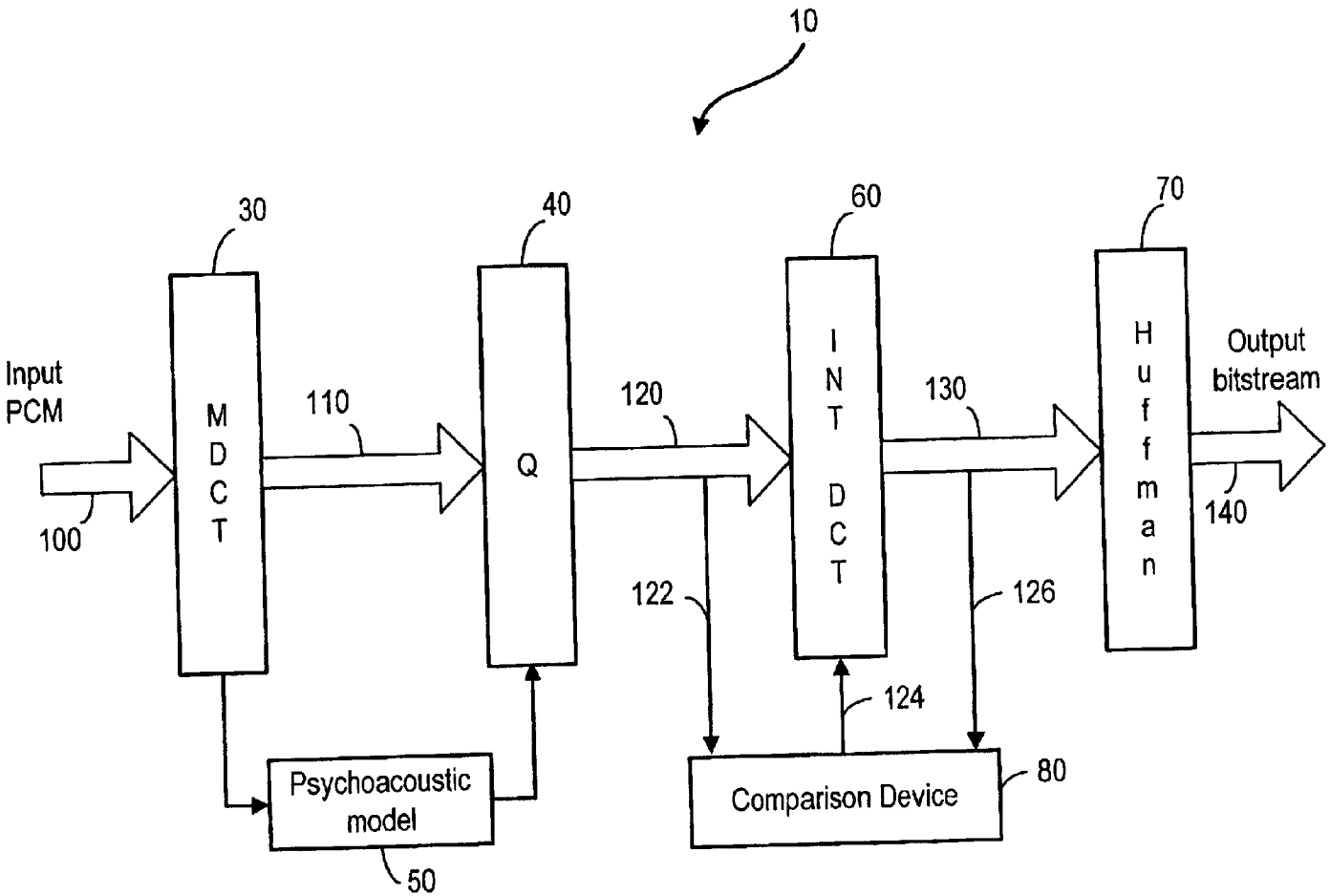
FIG. 3 is a diagrammatic representation illustrating an audio coding method for inter-channel signal redundancy reduction, according to the present invention.

Unlike the conventional coding method, the present invention relies on the integer-to-integer discrete cosine transform (INT-DCT) of the modified discrete cosine transform (MDCT) coefficients, after the MDCT coefficients are quantized into integers. As shown in FIG. 3, the audio coding system 10 comprises a modified discrete cosine transform (MDCT) unit 30 to reduce intra-channel signal redundancy in the input pulsed code modulation (PCM) samples 100. The output of the MDCT unit 30 are modified discrete cosine transform (MDCT) coefficients 110. These coefficients, representing a 2-D spectral image of the audio signal, are quantized by a quantization unit 40 into quantized MDCT coefficients 120. In addition, a masking mechanism 50, based on a so-called psychoacoustic model, is used to remove the audio data believed not be used by a human auditory system. As shown in FIG. 3, the masking mechanism 50 is operatively connected to the quantization unit 40 for masking out the audio data according to the intra-channel MDCT manner. The masked 2-D spectral image is quantized according to the masking threshold calculated using the psychoacoustic model. In order to reduce the cross-channel redundancy, an INT-DCT unit 60 is used to perform INT-DCT inter-channel decorrelation. The processed MDCT coefficients are collectively denoted by reference numeral 130. The processed coefficients 130 are then Huffman coded and written into a bitstream 140 for transmission or storage. Preferably, the coding system 10 also comprises a comparison device 80 to determine whether to bypass the INT-DCT unit 60 based on the cross-channel redundancy removal efficiency of the INT-DCT 60 at certain frequency bands (see FIG. 4*c* and FIG. 5). As shown in FIG. 3, the coding efficiency in the signals 120 and that in the signals 130 are denoted by reference numerals 122 and 126, respectively. If the coding efficiency 126 is not greater than the coding efficiency 122 at certain frequency bands, the comparison device 80 send a signal 124 to effect the bypass of the INT-DCT unit 60 regarding those frequency bands.

Figure 4A:
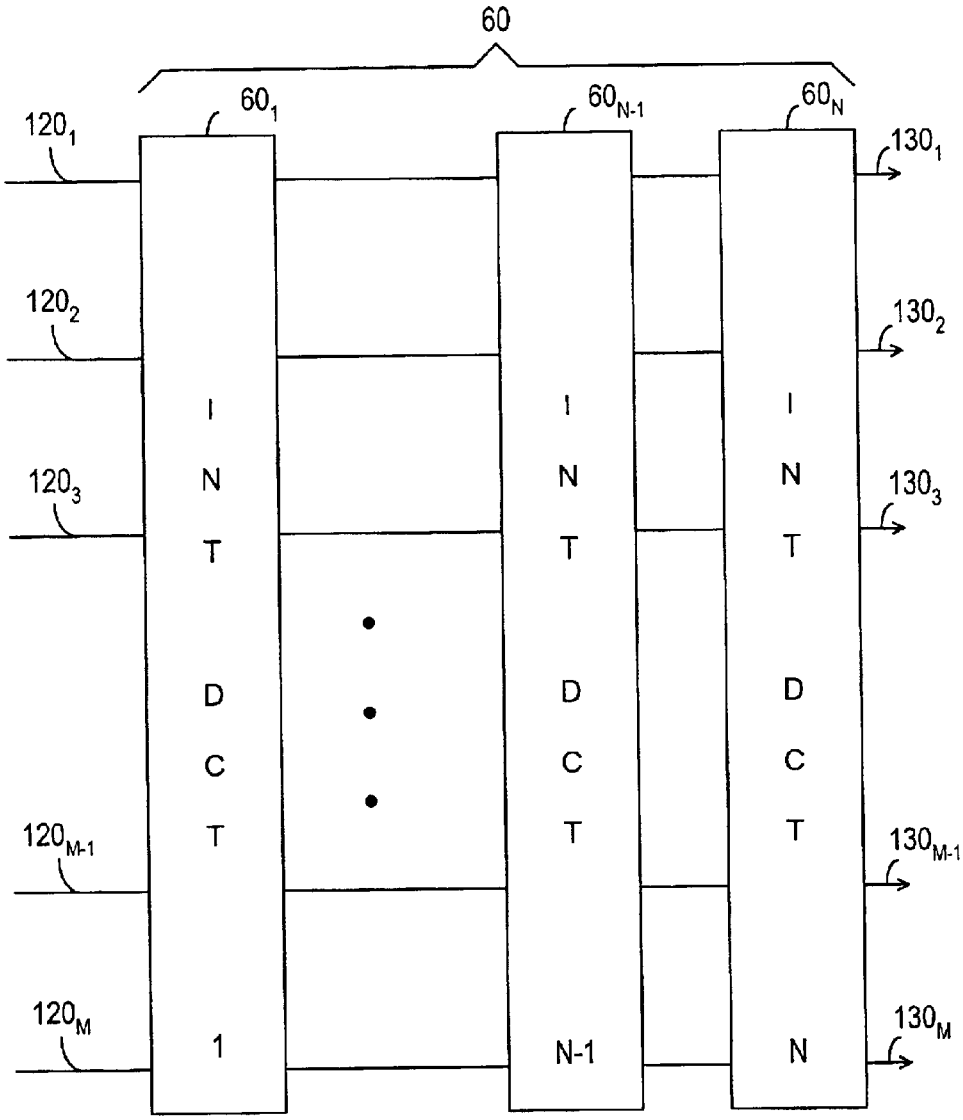
FIG. 4*a* is a diagrammatic representation illustrating the audio coding method, according to the present invention, using an M channel integer-to-integer discrete cosine transform in an M channel sound system.
Figure 4B:
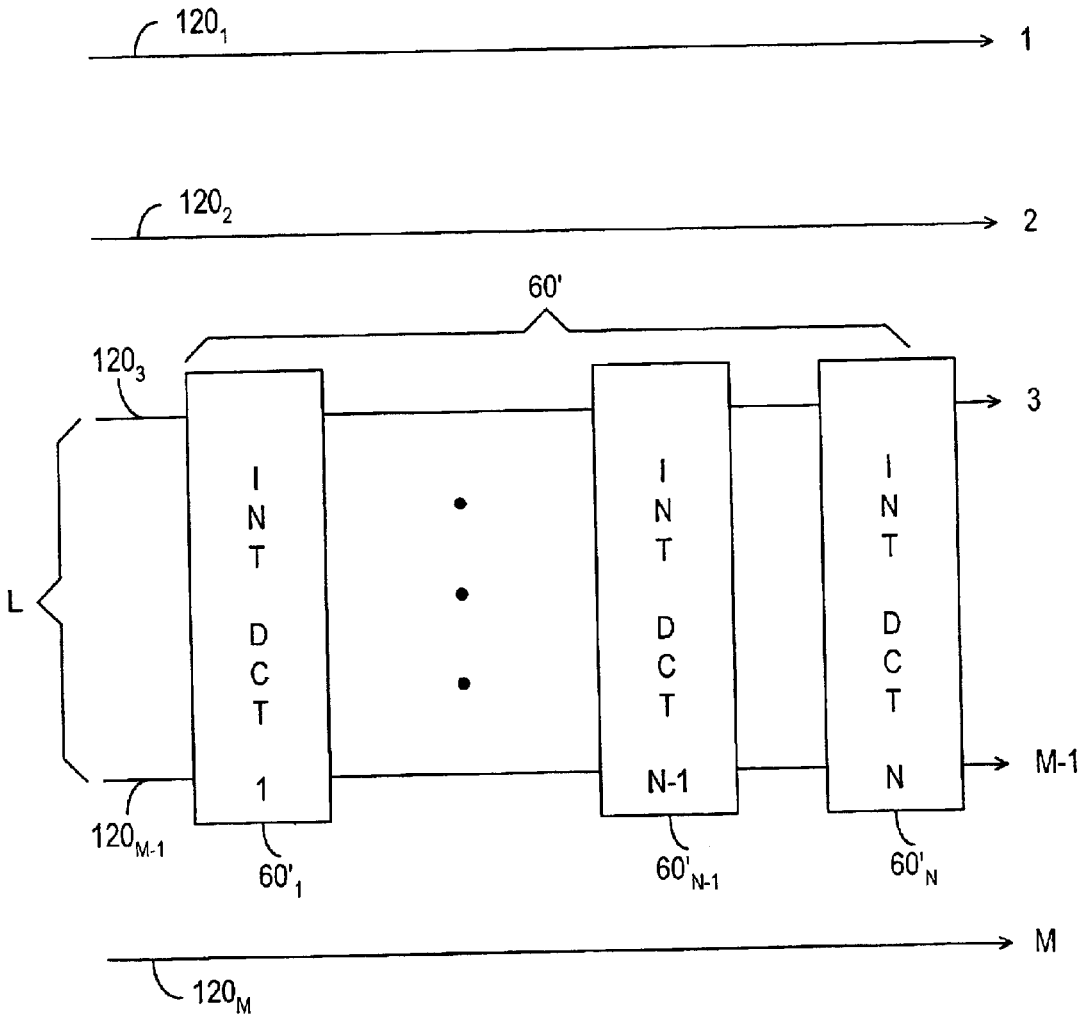
FIG. 4*b* is a diagrammatic representation illustrating the audio coding method, according to the present invention, using an L channel integer-to-integer discrete cosine transform in an M channel sound system, where L<M.

It should be noted that in an M channel sound system, according to the present invention, the inter-channel signal redundancy in the quantized MDCT coefficients can be reduced by one or more INT-DCT units. As shown in FIG. 4*a*, a group of M-tap INT-DCT modules $\mathbf{60}_1, \ldots, \mathbf{60}_{N-1}, \mathbf{60}_N$ are used to process the quantized MDCT coefficients $\mathbf{120}_1$, $\mathbf{120}_2, \mathbf{120}_3, \ldots, \mathbf{120}_{M-1}$, and $\mathbf{120}_M$. After the inter-channel signal redundancy is reduced, the coefficients representing the sound signals are denoted by reference numerals $\mathbf{130}_1$, $\mathbf{130}_2, \mathbf{130}_3, \ldots, \mathbf{130}_{M-1}$, and $\mathbf{130}_M$. It is also possible to use a group of L-tap INT-DCT modules $\mathbf{60}_1', \ldots, \mathbf{60}_{N-1}', \mathbf{60}_N'$ to reduce the inter-channel signal redundancy in L channels, where 2<L<M, as shown in FIG. 4*b*. For example, in a 5-channel sound system consisting of left (L), right (R), center (C), left-surround (LS) and right-surround (RS) channels, it is possible to perform the integer-to-integer DCT of the quantized MDCT coefficients involving only 4 channels, namely L, R, LS and RS. Likewise, in a 12-channel sound system, it is possible to perform the inter-channel decorrelation in 5 or 6 channels.

Figure 5:
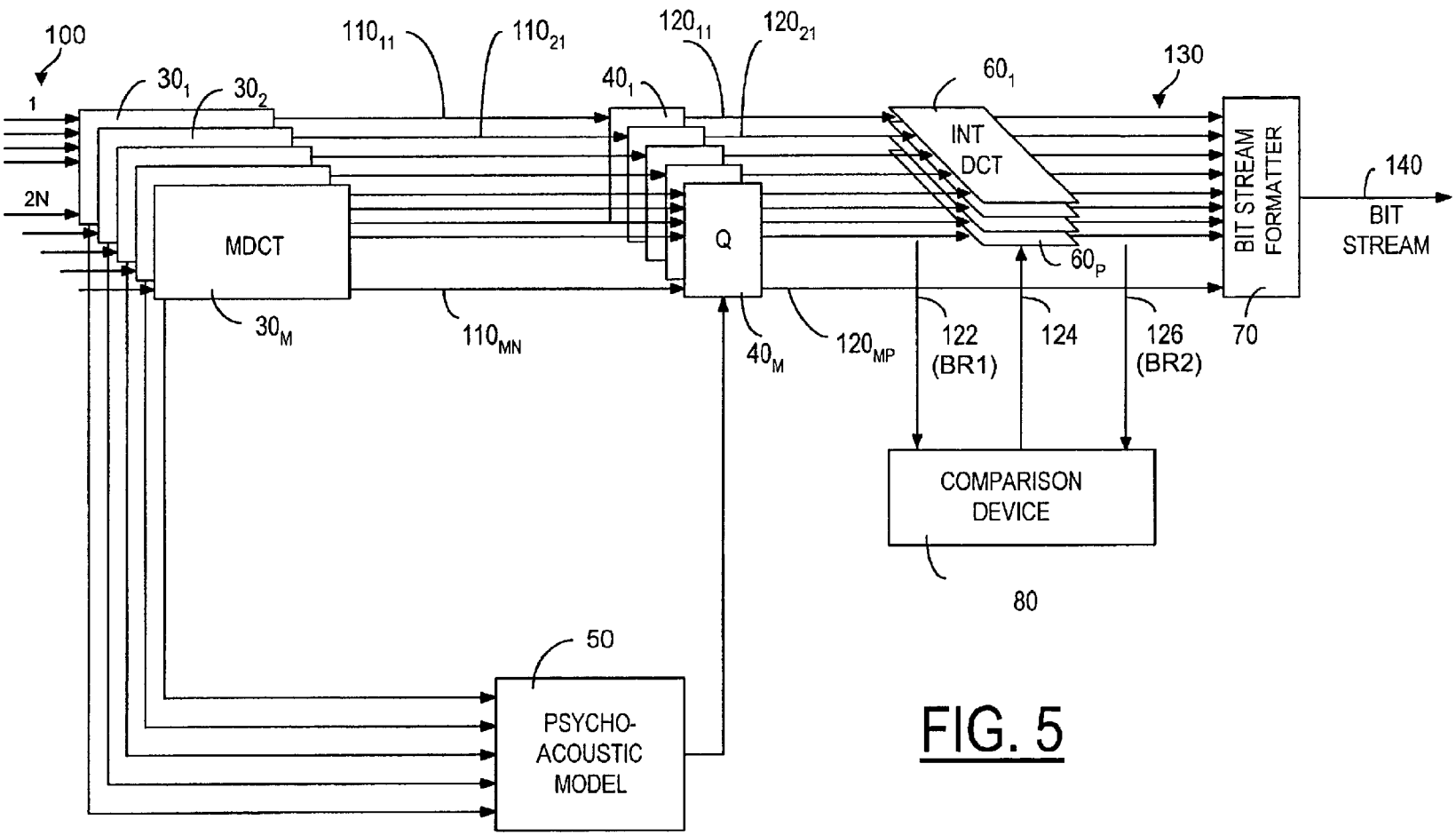
FIG. 5 is a block diagram illustrating a system for audio coding, according to the present invention.

FIG. 5 shows the audio coding system 10 of present invention in more detail. As shown in FIG. 5, each of M MDCT devices $\mathbf{30}_1, \mathbf{30}_2, \ldots, \mathbf{30}_M$, respectively, are used to obtain the MDCT coefficients from a block of 2N pulsed code modulation (PCM) samples for one of the M audio channels (not shown). Thus, the total number of PCM samples for M channels is M×2N. This block of PCM samples is collectively denoted by reference numeral 100. It is understood that the M×2N PCM pulsed may have been pre-processed by a group of M Shifted Discrete Fourier Transform (SDFT) devices (not shown) prior to being conveyed to the MDCT devices $\mathbf{30}_1, \mathbf{30}_2, \ldots, \mathbf{30}_M$. $\mathbf{30}_M$ to perform the intra-channel decorrelation. When a block of 2N samples (2N being the transform length) are used to compute a series of MDCT coefficients, the maximum number of INT-DCT devices in each stage is equal to the number of MDCT coefficients for each channel. The transform length 2N is determined by transform gain, computational complexity and the pre-echo problem. With a transform length of 2N, the number of the MDCT coefficients for each channel is N. Typically, the MDCT transform length 2N is between 256 and 2048, resulting in 128 (short window) to 1024 (long window) MDCT coefficients. Accordingly, the number of INT-DCT devices required to remove cross-channel redundancy at each stage is between 128 and 1024. In practice, however, the number of INT-DCT units can be much smaller. As shown in FIG. 5, only P INT-DCT units $\mathbf{60}_1$, $\mathbf{60}_2, \ldots, \mathbf{60}_p$ (p<N) to remove cross channel signal redundancy after the MCDT coefficient are quantized by quantization units $\mathbf{40}_1, \mathbf{40}_2, \ldots, \mathbf{40}_M$ into quantized MDCT coefficients. The MDCT coefficients are denoted by reference numerals $\mathbf{110}_{j1}, \mathbf{110}_{j2}, \mathbf{110}_{j3}, \ldots, \mathbf{110}_{j(N-1)}$, and $\mathbf{110}_{jN}$, where j denotes the channel number. The quantized MDCT coefficients are denoted by reference numerals $\mathbf{120}_{j1}, \mathbf{120}_{j2}$, $\mathbf{120}_{j3}, \ldots, \mathbf{120}_{j(N-1)}$, and $\mathbf{120}_{jN}$. After INT-DCT processing, the audio signals are collectively denoted by reference numeral 130, Huffman coded and written to a bitstream 140 by a Bitstream formatter 70.

Figure 4C:
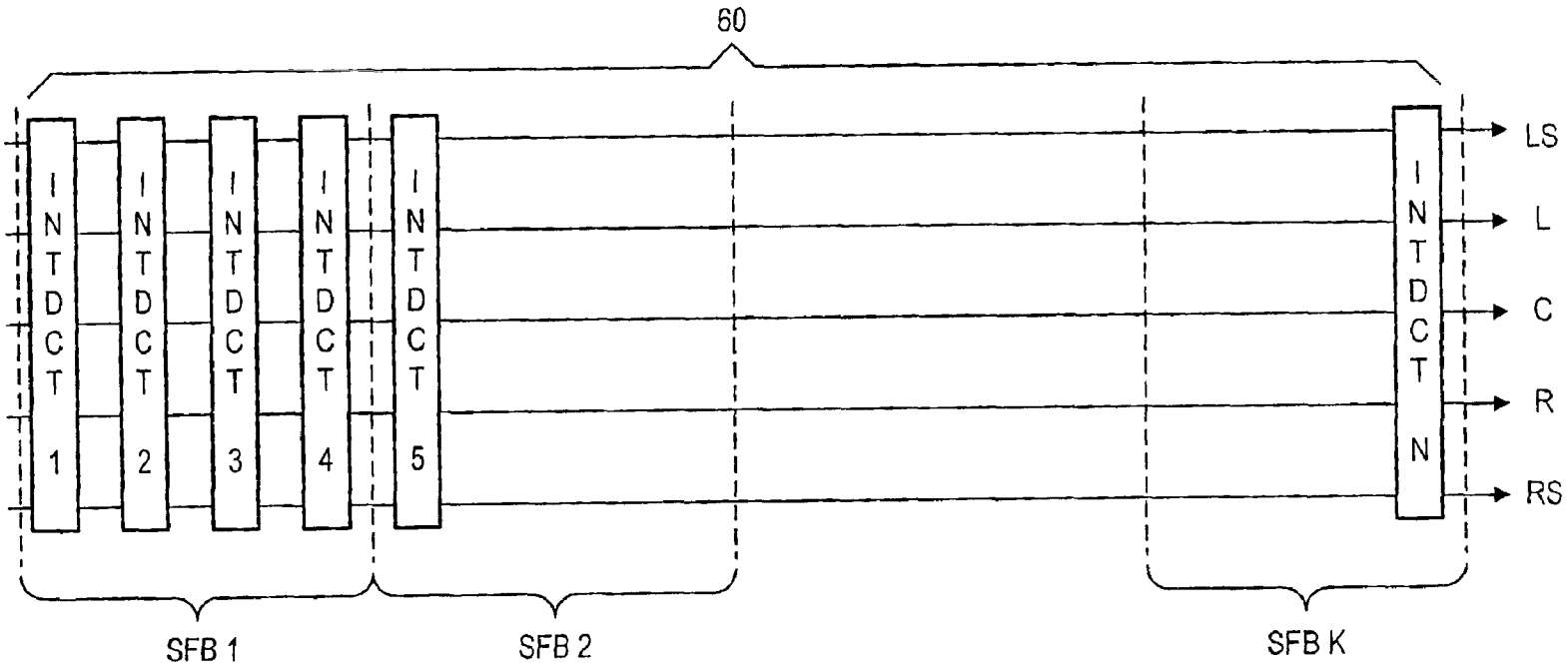
FIG. 4*c* is a diagrammatic representation illustrating the MDCT coefficients are divided into a plurality of scale factor bands.

It should be noted that, each MDCT device transforms the audio signals in the time domain into the audio signals in the frequency domain. The audio signals in certain frequency bands may not produce noticeable sound in the human auditory system. According to the coding principle of MPEG-2 Advanced Audio Coding (AAC), the NMDCT coefficients for each channel are divided into a plurality of scale factor bands (SFB), modeled after the human auditory system. The scale factor bandwidth increases with frequency roughly according to one third octave bandwidth. As shown in FIG. 4*c*, the N MDCT coefficients for each channel are divided into SFB1, SFB2, . . . , SFBK for further processing by N INT-DCT units. With N=128 (short window), K=14. With N=1024 (long window), K=49. The total bits needed to represent the MDCT coefficients within each SFB for all channels are calculated before and after the INT-DCT cross-channel redundancy removal. Let the number of total bits for all channels before and after INT-DCT processing be BR1 and BR2 as conveyed by signal 122 and signal 126, respectively. The comparison device 80, responsive to signals 122 and 126, compares BR1 and BR2 for each SFB. If BR1>BR2 for an SFB, then the INT-DCT unit for that SFB is used to reduce the cross channel redundancy. Otherwise, the INT-DCT unit for that SFB can be bypassed, or the cross-channel redundancy-removal process for that SFB is not carried out. In order to bypass the INT-DCT unit, the comparison device 80 sends a signal 124 for effecting the bypass in the encoder. It should be noted that, it is necessary for the encoder to inform the decoder whether or not INT-DCT is used for a SFB, so that the decoder knows whether an inverse INT-DCT is needed or not. The information sent to the decoder is known as side information. The side information for each SFB is only one bit, added to the bitstream 140 for transmission or storage.

Because of the energy compaction properties of the MCDT, the MDCT coefficients in high frequencies are mostly zeros. In order to save computation and side information, the P INT-DCT units may be used to low and middle frequencies only.

Each of the INT-DCT devices is used to perform an integer-to-integer discrete cosine transform represented by an orthogonal transform matrix A. Let x be an M×1 input vector representing M quantized MDCT coefficients $\mathbf{110}_{1k}$, $\mathbf{110}_{2k}, \mathbf{110}_{3k}, \ldots, \mathbf{110}_{Mk}$, then Ax is an M×1 output vector representing M INT-DCT coefficients $\mathbf{120}_{1k}$, $\mathbf{120}_{2k}$, $120_{3k}$, . . . , $120_{Mk}$. The integer-to-integer transform is created by first factorizing the transform matrix A into a plurality of matrices that have 1's on the diagonal and non-zero off-diagonal elements only in one row or column. It has been found that the factorization is not unique. Thus, it is possible to use elementary matrices to reduce the transform matrix A into a unit matrix, if possible, and then use the inverse of the elementary matrixes as the factorization. Because the transform matrix A is orthogonal, it is possible to factorize the transform matrix A into Givens matrices and then further factorize each of the Givens matrices into three matrices that can be used as building blocks of the integer-to-integer transform. For simplicity, a sound system having M=3 channels is used to demonstrate the INT-DCT cross-channel decorrelation, according to the present invention.

A matrix that has 1's on the diagonal and nonzero off-diagonal elements only in one row or column can be used as a building block when constructing an integer-to-integer transform. This is called 'the lifting scheme'. Such a matrix has an inverse also when the end result is rounded in order to map integers to integers.

Let us consider the case of a 3×3 matrix (a,b ϵ R, $x_1$, ϵZ)

$$\left\|\begin{bmatrix}1&0&0\\a&1&b\\0&0&1\end{bmatrix}\begin{bmatrix}x_1\\x_2\\x_3\end{bmatrix}\right\|_\Delta = \left\|\begin{bmatrix}x_1\\ax_1+x_2+bx_3\\x_3\end{bmatrix}\right\|_\Delta = \begin{bmatrix}x_1\\x_2+|ax_1+bx_3|_\Delta\\x_3\end{bmatrix} \tag{1}$$

where $\|_\Delta$ denotes rounding for the nearest integer. The inverse of (1) is $$\left\|\begin{bmatrix}1&0&0\\-a&1&-b\\0&0&1\end{bmatrix}\begin{bmatrix}x_1\\x_2+|ax_1+bx_3|_\Delta\\x_3\end{bmatrix}\right\|_\Delta = \left\|\begin{bmatrix}x_1\\-ax_1+x_2+|ax_1+bx_3|_\Delta-bx_3\\x_3\end{bmatrix}\right\|_\Delta = \begin{bmatrix}x_1\\x_2+|-ax_1+|ax_1+bx_3|_\Delta-bx_3|_\Delta\\x_3\end{bmatrix} = \begin{bmatrix}x_1\\x_2\\x_3\end{bmatrix} \tag{2}$$

A Givens rotation is a matrix of the form:

$$G(i,k,\theta) = \begin{array}{c} \left[\begin{array}{c|c|c|c} 1 & 0 & 0 & 0 \\ \hline 0 & c & s & 0 \\ \hline 0 & -s & c & 0 \\ \hline 0 & 0 & 0 & 1 \end{array}\right] \begin{array}{c} \\ i \\ k \\ \\ \end{array} \\ \begin{array}{cccc} \phantom{1} & i & k & \phantom{1} \end{array} \end{array}, \tag{3}$$

where c=cos(θ), s=sin (θ)

A Givens matrix is clearly orthogonal and the inverse is $$G(i,k,\theta)^{-i} = \begin{array}{c} \left[\begin{array}{c|c|c|c} 1 & 0 & 0 & 0 \\ \hline 0 & c & -s & 0 \\ \hline 0 & s & c & 0 \\ \hline 0 & 0 & 0 & 1 \end{array}\right] \begin{array}{c} \\ i \\ k \\ \\ \end{array} \\ \begin{array}{cccc} \phantom{1} & i & k & \phantom{1} \end{array} \end{array} \tag{4}$$

Any m×m orthogonal matrix can be factorized into m(m−1)/2 Givens rotations and m sign parameters.

As an example, let A be an orthogonal matrix.

Firstly, $\theta_1$ can be chosen such that tan $$(\theta_i) = \frac{a_{2,3}}{a_{3,3}}.$$

It follows that $$G(2,3,\theta_1)^{-1}\cdot A = \begin{bmatrix}1&0&0\\0&\cos(\theta_1)&-\sin(\theta_1)\\0&\sin(\theta_1)&\cos(\theta_1)\end{bmatrix}\begin{bmatrix}a_{1,1}&a_{1,2}&a_{1,3}\\a_{2,1}&a_{2,2}&a_{2,3}\\a_{3,1}&a_{3,2}&a_{3,3}\end{bmatrix} = \begin{bmatrix}a_{1,1}&a_{1,2}&a_{1,3}\\b_{2,1}&b_{2,2}&0\\b_{3,1}&b_{3,2}&b_{3,3}\end{bmatrix} = B \tag{5}$$

If $a_{3.3}$=0, then $\theta_1=\pi/2$ i.e. $\cos(\theta_1)=0$, $\sin(\theta_1)=1$ is chosen. This matrix still has an inverse, even when used to create an integer-to-integer transform.

Secondly, $\theta_2$ is chosen such that $$\tan(\theta_2) = \frac{a_{1,3}}{b_{3,3}},$$

$$G(1,3,\theta_2)^{-1}\cdot B = \begin{bmatrix}\cos(\theta_2)&0&-\sin(\theta_2)\\0&1&\\\sin(\theta_2)&0&\cos(\theta_2)\end{bmatrix}\begin{bmatrix}a_{1,1}&a_{1,2}&a_{1,3}\\b_{2,1}&b_{2,2}&0\\b_{3,1}&b_{3,2}&b_{3,3}\end{bmatrix} = \begin{bmatrix}c_{1,1}&c_{1,2}&0\\b_{2,1}&b_{2,2}&0\\c_{3,1}&c_{3,2}&c_{3,3}\end{bmatrix} = C \tag{6}$$

Now, since both $G(2,3,\theta_1)^{-1}$, $G(1,3,\theta_2)^{-1}$ and also A are orthogonal, therefore, C has to be orthogonal, and every row and column in C has unit norm. Thus, $c_{3,3}=\pm1$ and $c_{3,1}$, $c_{3,2}=0$ $$C = \begin{bmatrix}c_{1,1}&c_{1,2}&0\\b_{2,1}&b_{2,2}&0\\0&0&\pm1\end{bmatrix} \tag{7}$$

Lastly, $\theta_3$ is chosen such that $$\tan(\theta_3) = \frac{c_{1,2}}{b_{2,2}},$$

$$G(1, 2, \theta_3)^{-1} \cdot C = \begin{bmatrix} \cos(\theta_3) & -\sin(\theta_3) & 0 \\ \sin(\theta_3) & \cos(\theta_3) & 0 \\ 0 & 0 & 1 \end{bmatrix} \begin{bmatrix} c_{1,1} & c_{1,2} & 0 \\ c_{2,1} & c_{2,2} & 0 \\ 0 & 0 & \pm 1 \end{bmatrix} = \begin{bmatrix} d_{1,1} & 0 & 0 \\ d_{2,1} & d_{2,2} & 0 \\ 0 & 0 & \pm 1 \end{bmatrix} = D \tag{8}$$

Since $G(1,2,\theta_3)^{-1}$ and C are orthogonal, D must be orthogonal.

$$D = \begin{bmatrix} \pm 1 & 0 & 0 \\ 0 & \pm 1 & 0 \\ 0 & 0 & \pm 1 \end{bmatrix}$$

Finally:

$$G(1,2,\theta_3)^{-1} \cdot G(1,3,\theta_2)^{-1} \cdot G(2,3,\theta_1)^{-1} \cdot A = D \tag{9}$$

Taking D as the sign matrix:

$$D \cdot G(1,2,\theta_3)^{-1} \cdot G(1,3,\theta_2)^{-1} \cdot G(2,3,\theta_1)^{-1} \cdot A = I \tag{10}$$

Therefore, A can be factorized as:

$$A = G(2,3,\theta_1) \cdot G(1,3,\theta_2) \cdot G(1,2,\theta_3) \cdot D \tag{11}$$

For m×m matrices, the operation is similar. Givens rotations can in turn be factorized as follows:

$$G(i, k, \theta) = \begin{bmatrix} 1 & 0 & 0 & 0 \\ 0 & c & s & 0 \\ 0 & -s & c & 0 \\ 0 & 0 & 0 & 1 \end{bmatrix} = \begin{bmatrix} 1 & 0 & 0 & 0 \\ 0 & 1 & (1-c)/s & 0 \\ 0 & 0 & 1 & 0 \\ 0 & 0 & 0 & 1 \end{bmatrix} \begin{bmatrix} 1 & 0 & 0 & 0 \\ 0 & 1 & 0 & 0 \\ 0 & -s & 1 & 0 \\ 0 & 0 & 0 & 1 \end{bmatrix} \begin{bmatrix} 1 & 0 & 0 & 0 \\ 0 & 1 & (1-c)/s & 0 \\ 0 & 0 & 1 & 0 \\ 0 & 0 & 0 & 1 \end{bmatrix} \tag{12}$$

when θ is not an integral multiple of 2π. If it is, then the Givens rotation matrix equals the unity matrix and no factorization is necessary. These factors are denoted as $G(i,k,\theta)_1$, $G(i,k,\theta)_2$ and $G(i,k,\theta)_3$. A transform that behaves similarly to matrix A, maps integers to integers and is reversible is then $$|G(2, 3, \theta_1)_1 \cdot |G(2, 3, \theta_1)_2 \cdot |G(2, 3, \theta_1)_3 \cdot | \ldots |G(1, 2, \theta_3)_1 \cdot |G(1, 2, \theta_3)_2 \cdot |G(1, 2, \theta_3)_3 \cdot D \cdot x|_\Delta|_\Delta \ldots |_\Delta|_\Delta|_\Delta \tag{13}$$

where x is the integer 3×1 input vector.

In order to remove cross-channel redundancy in L channels, an L×L orthogonal transform matrix A is factorized into L(L−1)/2 Givens rotations. Givens rotations are further factorized into 3 matrices each, resulting in the total of 3L(L−1)/2 matrix multiplications. However, because of the internal structure of these matrices, only 3L(L−1)/2 multiplications and 3L(L−1)/2 rounding operations are needed in total for each INT-DCT operation.

The efficiency of the cascaded INT-DCT coding process in removing cross-channel redundancy, in general, increases with the number of sound channels involved. For example, if a sound system consists of 6 or more surround sound speakers, then the reduction in cross-channel redundancy using the INT-DCT processing is usually significant. However, if the number of channels to be used in the INT-DCT processing is 2, then the efficiency may not be improved at all. It should be noted that, like any perceptual audio coder, the goal of cascaded INT-DCT processing is to reduce the audio data for transmission or storage. While the processing method is intended to produce signal outputs similar to what a human auditory system might perceive, its goal is not to replicate the input signals.

It should be noted that the so-called psychoacoustic model may consist of a certain perceptual model and a certain band mapping model. The surround sound encoding system may consist of components such as an AAC gain control and a certain long-term prediction model. However, these components are well known in the art and they can be modified, replaced or omitted.

Figure 4D:
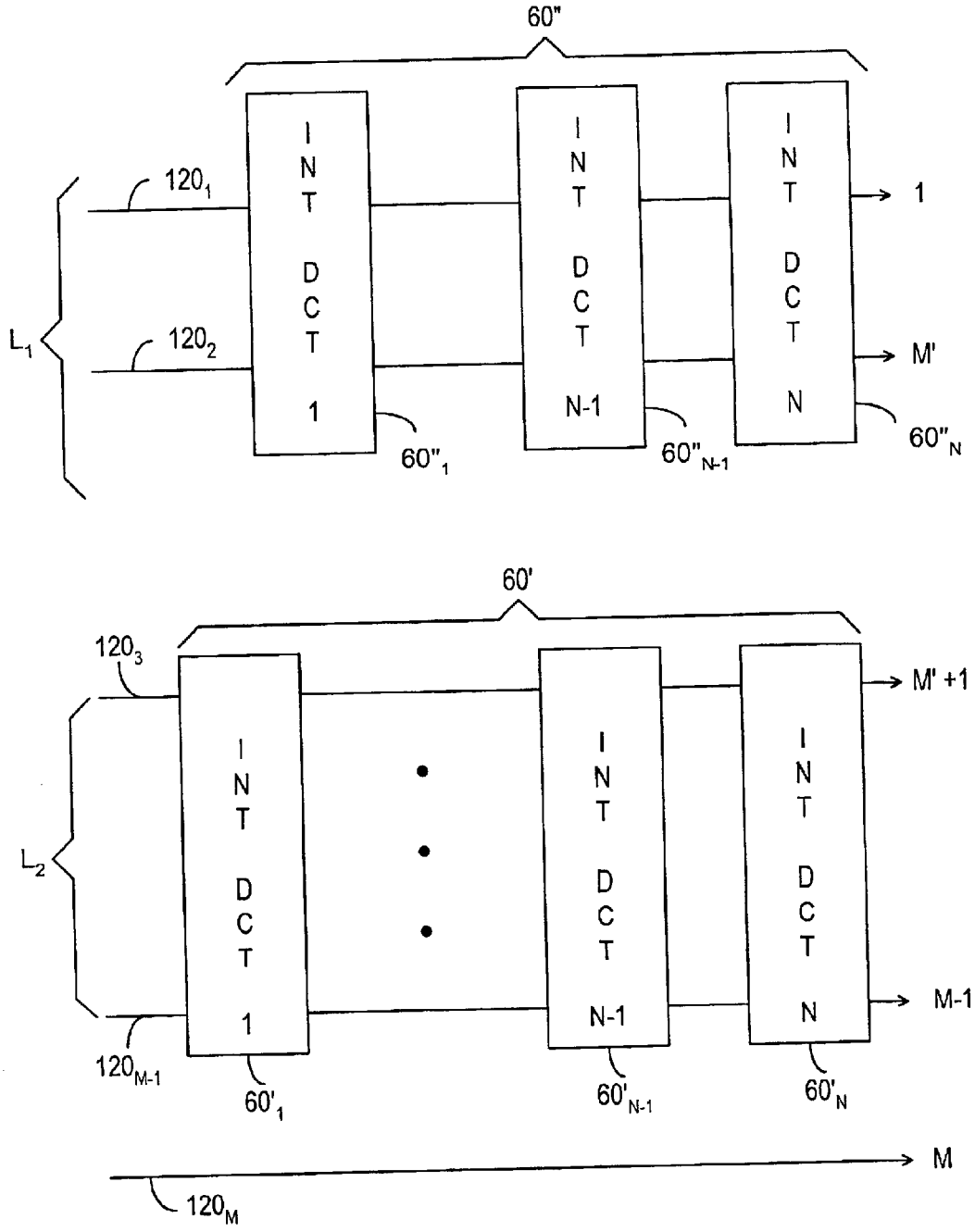
FIG. 4*d* is a diagrammatic representation illustrating the audio coding method, according to the present invention, using two groups of integer-to-integer discrete cosine transform modules in an M channel sound channel system.

Furthermore, in an M-channel sound system, according to the present invention, the inter-channel signal redundancy in the quantized MDCT coefficients can be reduced by a number of groups of INT-DCT units. As shown in FIG. 4*d*, there is no or little correlation between channels 1 to M' and channels M'+1 to M−1, and it would be more meaningful to perform INT-DCT for each group of channels separately. As shown, a group $L_1$ of M'-tap INT-DCT modules $\mathbf{60}''_1, \ldots, \mathbf{60}''_{N-1}, \mathbf{60}''_N$ and a group $L_2$ of (M−M'−1)-tap INT-DCT modules $\mathbf{60}_1', \ldots, \mathbf{60}_{N-1}', \mathbf{60}_N'$ are used to process the quantized MDCT coefficients $\mathbf{120}_1, \mathbf{120}_2, \mathbf{120}_3, \ldots, \mathbf{120}_{M-1}$, and $\mathbf{120}_M$ in (M−1) channels. For example, in a cinema having 8 front sound channels and 10 rear sound channels where there is no or little correlation between the front and rear channels, it is desirable to process the sound signals in the front channels and the rear channels separately. In this situation, it is possible to use a group of 8-tap INT-DCT modules to reduce the cross-channel signal redundancy in the 8 front channels and a group of 10-tap INT-DCT modules to process the 10 rear channels. In general, it is possible to use one, two or more groups of INT-DCT modules to reduce the cross-channel signal redundancy in an M-channel sound system.

Thus, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. A method of coding audio signals in a sound system having a plurality of sound channels for providing M sets of audio signals from input signals, wherein M is a positive integer greater than 2, and wherein a plurality of intra-channel signal redundancy removal devices are used to reduce the audio signals for providing first signals in the plurality of sound channels indicative of the reduced audio signals, said method comprising the steps of:

converting the first signals in at least two of the plurality of sound channels to audio data for providing second signals in said at least two sound channels indicative of the audio data;

quantizing the second signals according to a masking threshold for providing a further second signals; and operatively engaging the further second signals in said at least two sound channels, separately from the intra-channel signal redundancy removal devices, for reducing inter-channel signal redundancy in the further second signals in order to provide third signals indicative of the reduced further second signals in said at least two sound channels.

2. The method of claim 1, wherein the audio signals from which the intra-channel signal redundancy is removed are provided in a form of pulsed code modulation samples.

3. The method of claim 1, wherein the intra-channel signal redundancy removal is carried out by a modified discrete cosine transform operation.

4. The method of claim 1, wherein the inter-channel signal redundancy reduction is carried out in an integer-to-integer discrete cosine transform operation.

5. The method of claim 1, wherein the inter-channel signal redundancy reduction is carried out for reducing redundancy in the audio signals in L channels, wherein L is a positive integer greater than 2 but smaller than M+1.

6. The method of claim 1, wherein the inter-channel signal redundancy reduction is carried out for reducing redundancy in the audio signals in at least one group of $L_1$ channels and one group of $L_2$ channels separately, wherein $L_1$ and $L_2$ are positive integers greater than 2 and $(L_1+L_2)$ is smaller than M+1.

7. The method of claim 1, further comprising a signal masking step in accordance with a psychoacoustic model simulating a human auditory system for masking the first signals.

8. The method of claim 1, further comprising the step of converting the third signals into a further bitstream for transmitting or storage.

9. A method of coding audio signals in a sound system having a plurality of sound channels for providing M sets of audio signals from input signals, wherein M is a positive integer greater than 2, and wherein a plurality of intra-channel signal redundancy removal devices are used to reduce the audio signals for providing first signals indicative of the reduced audio signals, said method comprising the steps of:

convening the first signals to audio data of integers for providing second signals indicative of the audio data; and reducing inter-channel signal redundancy in the second signals for providing third signals indicative of the reduced second signals, wherein the second signals are divided into a plurality of scale factor bands and the third signals are divided into a plurality of corresponding scale factor bands, said method further comprising the step of comparing coding efficiency in the second signals to coding efficiency in the third signals in corresponding scale factor bands, for bypassing the reducing step if the coding efficiency in the third signals is smaller than the coding efficiency in the second signals.

10. A system for coding audio signals in a sound system having a plurality of sound channels for providing M sets of audio signals from input signals, wherein M is a positive integer greater than 2, and wherein a plurality of intra-channel signal redundancy removal devices are used to reduce the audio signals for providing first signals indicative of the reduced audio signals, said system comprising:

a first means, responsive to the first signals, for converting the first signals to audio data of integers for providing second signals indicative of the audio data; and a second means, responsive to the second signals, for reducing inter-channel signal redundancy in the second signals for providing third signals indicative of the reduced second signals, wherein the second signals are divided into a plurality of scale factor bands and the third signals are divided into a plurality of corresponding scale factor bands, and wherein coding efficiency in the second signals in a scale factor band is representable by a first value and coding efficiency in the third signals in the corresponding scale factor band is representable by a second value, said system further comprising a comparison means, responsive to the second and third signals, for bypassing the inter-channel signal redundancy reduction in said scale band factor by the second means when the first value is greater or equal to the second value.

11. A system for coding audio signals in a sound system having a plurality of sound channels for providing M sets of audio signals from input signals, wherein M is a positive integer greater than 2, and wherein a plurality of intra-channel signal redundancy removal devices are used to reduce the audio signals for providing first signals in the plurality of sound channels indicative of the reduced audio signals, said system comprising:

a first means, responsive to the first signals, for converting the first signals in at least two of the plurality of sound channels to audio data for providing second signals in said at least two channels indicative of the audio data;

a quantization module, in response to the second signals, for quantizing audio data in the second signals according to a masking threshold for providing further second signals; and a second means, disposed separately from the intra-channel signal redundancy removal devices and operatively engaging said at least two channels, for reducing inter-channel signal redundancy in the further second signals for providing third signals indicative of the reduced further second signals.

12. The system of claim 11, wherein the audio signals from which the intra-channel signal redundancy is removed are provided in a form of pulsed code modulation samples.

13. The system of claim 11, wherein the intra-channel signal redundancy removal is carried out by a modified discrete cosine transformation.

14. The system of claim 11, wherein the inter-channel signal redundancy reduction is carried out in an integer-to-integer discrete cosine transform.

15. The system of claim 11, wherein the inter-channel signal redundancy reduction is carried out in order to reduce redundancy in the audio signals in L channels, wherein L is a positive integer greater than 2 but smaller than M+1.

16. The system of claim 11, further comprising means for masking the first signals according to the masking threshold calculated from a psychoacoustic model simulating a human auditory system.

17. The system of claim 11, further comprising means, responsive to the third signals, for converting the third signals into a bitstream for transmitting or storage.

* * * * *

UNITED STATES PATENT AND TRADEMARK OFFICE

CERTIFICATE OF CORRECTION

PATENT NO. : 6,934,676 B2
DATED : August 23, 2005
INVENTOR(S) : Wang et al.

It is certified that error appears in the above-identified patent and that said Letters Patent is hereby corrected as shown below:

Column 11,
Line 46, “convening” should be -- converting --.

Signed and Sealed this

Eighth Day of November, 2005

JON W. DUDAS
*Director of the United States Patent and Trademark Office*